United States Patent [19]

Skedeleski et al.

[11] Patent Number: 4,955,314

[45] Date of Patent: Sep. 11, 1990

[54] WATER SPORT BOARD SAFETY TIP WITH ATTACHMENT FACILITATING EXTENSIONS

[75] Inventors: David Skedeleski; Eric Arakawa, both of Aiea, Hi.

[73] Assignee: Surfco of Hawaii, Aiea, Hi.

[21] Appl. No.: 381,204

[22] Filed: Jul. 18, 1989

[51] Int. Cl.[5] ..... A63C 15/05

[52] U.S. Cl. ..... 114/219; 441/74

[58] Field of Search ..... 114/219, 229, 126, 361; 280/608; 441/74, 65

[56] References Cited

U.S. PATENT DOCUMENTS

| | | | |
|---|---|---|---|
| D. 216,032 | 11/1969 | Howe | D6/422 |
| 708,476 | 9/1902 | Higgins | 114/219 |
| 3,374,495 | 3/1968 | Joyce | 114/219 |
| 4,167,050 | 9/1979 | Arcouette | 114/343 |
| 4,792,316 | 12/1988 | Skedeleski et al. | 114/219 |

FOREIGN PATENT DOCUMENTS

| | | | |
|---|---|---|---|
| 38745/85 | 6/1985 | Australia . | |
| 192821 | 11/1957 | Austria | 280/608 |

*Primary Examiner*—Joseph F. Peters, Jr.
*Assistant Examiner*—Jesûs D. Sotelo
*Attorney, Agent, or Firm*—Nixon & Vanderhye

[57] ABSTRACT

A protective tip cover for the sharply angled nose portion of a surfboard for reducing or preventing injury to a surfer or bystander upon impact with the nose portion of the board. Tip covers may be used for any type of surfboard, including those used for wind surfing. The cover comprises an integral relatively soft, resilient (e.g., silicone), member provided with a gently rounded apex portion, a main body portion, and upper and lower extensions. The extensions facilitate attachment of the tip cover to the upper and lower surfaces of the board, while providing the versatility to allow the safety tip to be used with a wide variety of different nose width and thickness boards.

20 Claims, 1 Drawing Sheet

FIG. 1
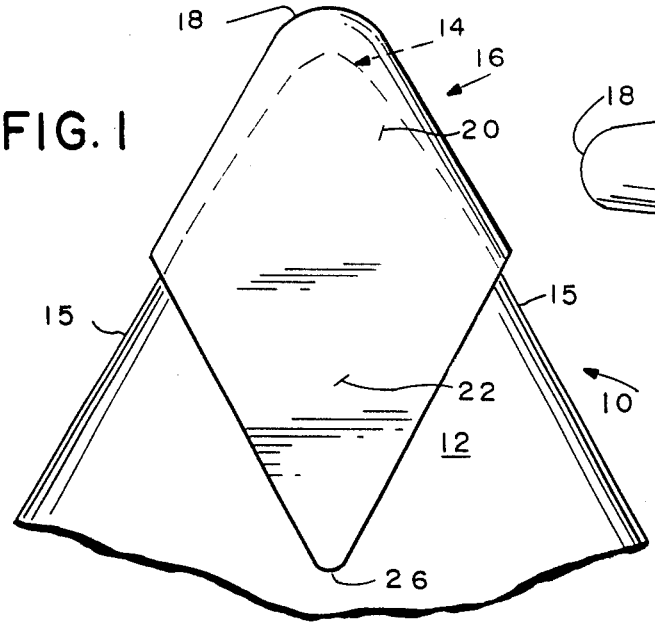
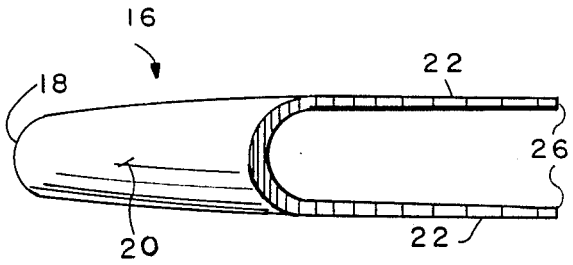
FIG. 2
FIG. 4
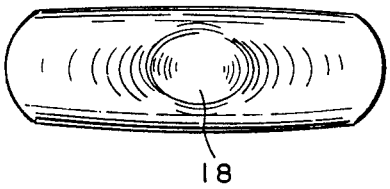
FIG. 3
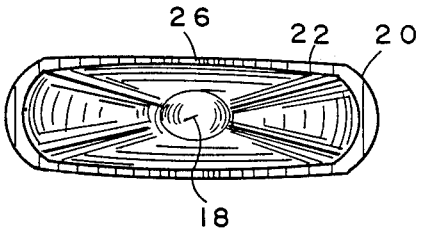
FIG. 5
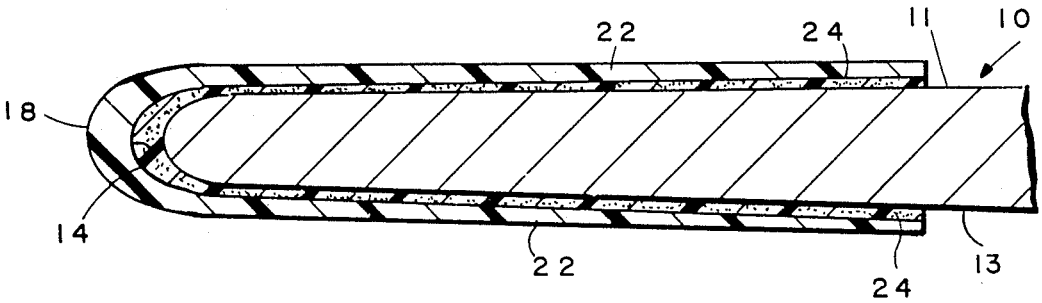

WATER SPORT BOARD SAFETY TIP WITH ATTACHMENT FACILITATING EXTENSIONS

BACKGROUND AND SUMMARY OF THE INVENTION

This invention relates to a safety device for water sport boards, to protect people using the boards or bystanders from injury should the tip of the board impact the user or bystander. The safety tip is a variation of that shown in our U.S. Pat. No. 4,792,316. The safety tip disclosed in that patent has been remarkably successful in the marketplace, and has gained wide acceptance in the industry. While it is an excellent and versatile product, for some water sport boards wider than conventional surfboards, or for surfboards that are thinner or thicker than conventional, the safety tip does not accommodate the boards quite to the extent desirable. A further modified form of that construction is disclosed in our co-pending patent application Ser. No. 07/287,975 filed Dec. 20, 1988, which is particularly useful in association with wind surfing boards. The revised construction of safety tip illustrated therein, because of its configuration, is essentially limited to wind surfing boards, and does not have broad versatility.

According to the present invention, a safety tip for a water sport board is provided that will accommodate wider, thinner, and thicker boards better than the design in our U.S. Pat. No. 4,792,316, and is applicable to all types of surfboards and the like, including—but not restricted to—wind surfing boards. The invention contains all of the same characteristics of the widely accepted protective tip of our U.S. Pat. No. 4,792,316 as far as protecting the surfers and bystanders, without adversely altering the performance characteristics of the board, are concerned. The material of which the safety tip according to the invention is made, and the general method of construction, are the same as for our patented tip, only the configuration of the tip being different.

According to the invention, there is provided in combination with a water sport board of the type having a sharply angled forward tip portion (including a top, bottom, and tapered sides) means for affording protection to the user of the board from injury upon contact with the tip portion, while not adversely altering the performance characteristics of the board. The protection affording means comprises an integral relatively soft, resilient plastic (preferably liquid injected silicone) tip cover, having a rounded exterior nose portion, a main body portion engaging the top, bottom, and tapered sides of the board, and upper and lower extension portions extending rearwardly from the body portion and engaging only the top and bottom of the board. The tip cover is fixedly secured to the tip portion of the board, for example by silicone adhesive between the body portion and the extension portions and the parts of the board that they overlay. The tip cover extension portions preferably taper to a point, and also preferably have a thickness decreasing slightly from the body portion to the pointed tip. The preferred material is liquid injected silicone having a durometer A hardness of about 35 to 40, a tensile strength of about 1,000–1,150 psi, and a tear resistance, Die B, of about 160–175 psi.

The invention also contemplates a protective tip cover for the forward tip of a water sport board which comprises a soft, resilient cushioning member for protecting the user of the board, the tip cover having been earlier described. Because of the construction of the tip cover, including the relatively short main body portion and with the upper and lower extensions which provide the primary mechanism for securement of the cover to the nose of the board, the tip cover according to the invention more easily accommodates wider, thinner, and thicker boards than the tip cover in our U.S. Pat. No. 4,792,316.

It is the primary object of the present invention to provide a versatile safety tip for water sport boards. This and other objects of the invention will become clear from an inspection of the detailed description of the invention and from the appended claims.

BRIEF DESCRIPTION OF THE DRAWINGS

FIG. 1 is a top plan view of an exemplary safety tip according to the invention shown in use on a surfboard;

FIG. 2 is a side elevational view of the tip of FIG. 1;

FIG. 3 is a rear elevational view of the tip of FIG. 1;

FIG. 4 is a front elevational view of the tip of FIG. 1; and

FIG. 5 is a detail cross-sectional view at the tip of the surfboard of FIG. 1.

DETAILED DESCRIPTION OF THE DRAWINGS

A water sport board 10 according to the invention having a forward portion 12 ending in a pointed nose or tip 14 comprises—in the drawings —a contemporary short type surfboard. The invention is utilizable with any type of surfboard, or the like, however, including wind surfing type surfboards. The surfboard 10 has a top surface 11 (see FIG. 5), a bottom surface 13, and angled sides 15. A tip cover 16 according to the invention comprises means for protecting a surfer, or bystander, from the pointed tip 14 of the board should the board impact the surfer or bystander, without adversely affecting the performance characteristics of the surfboard 10.

The device 16 comprises a generally rounded exterior nose portion 18, integral with a main body portion 20, and upper and lower extension portions 22. The material of which the device 16 is made is a relatively soft, resilient plastic material, such as silicone material. The tip cover 16 is preferably produced by injection molding liquid injected silicone material which has a durometer A hardness of about 35–40, a tensile strength of about 1,000–1,150 psi, and a tear resistance, Die B, of about 160–175 psi.

As can be seen in FIGS. 1 and 5 in particular, the main body 20 of the tip cover 16 engages parts of the top 11, bottom 13, and tapered sides 15 of the surfboard 10, while the upper and lower extension portions 22 extend rearwardly from the body 20 and engage only the top 11 and bottom 13. The main body portion 20 is just large enough to completely cover and adhere to the tip 14 of the surfboard 10. For example the total length of the main body 20 along the tapered sides 15 from the point 14 would typically be about ¾ of an inch to an inch and a half, whereas the widely accepted tip cover of our U.S. Pat. No. 4,792,316 typically would extend about two and a half inches along the tapered sides 15. Because the main body portion 20 covers only the tip 14, the tip cover 16 according to the invention is very versatile in accommodating water sport boards 10 of all different types of configurations. For example it can accommodate boards 10 which are much wider, thinner, or thicker than normal, including virtually all conventional types of surfboards, including wind surfing surfboards.

In order to properly secure the tip cover 16 to the surfboard 10, the extensions 22 are provided. Without the extensions there would often be insufficient surface area inter-engagement between the tip cover 16 and the surfboard 10 to properly and positively hold it in place. The extensions 22, however, provide a much larger area for the application of adhesive 24 or the like. The tip cover 16 is most desirably held in place utilizing an adhesive 24 which extends the entire extent of the main body portion 20 and the extensions 22. The adhesive 24 must be compatible with the plastic material of which the tip cover 16 is made, e.g. a silicone adhesive when the tip cover 16 is of silicone.

In the embodiment illustrated in the drawings, the extensions 22 taper to and terminate in a point 26. The thickness of the main body 20 and extensions 22 are such that they become slightly, though consistently, thinner from the rounded nose 18 to the point 26. The exact configuration of the extensions 22, aside from being free of the tapering side edges 15, is not critical, it only being necessary that there be sufficient surface area so that proper attachment of the tip cover 16 to the board 10 is provided. The "diamond" shape configuration in the drawings is merely aesthetic.

The tip cover 16 can be applied to original manufactured surfboards, or it can be sold in a kit in the aftermarket, as described fully in our U.S. Pat. No. 4,792,316.

It will thus be seen that according to the invention a surfboard safety tip structure has been provided which is versatile in accommodating a wide variety of different types of water sport boards, yet provides a desired safety function without interfering with the performance characteristics of the board. While the invention has been herein shown and described in what is presently conceived to be the most practical and preferred embodiments, it will be apparent to those of ordinary skill in the art that many modifications may be made thereof within the scope of the invention, which scope is to be accorded the broadest interpretation of the appended claims so as to cover all equivalent structures, devices, and combinations.

What is claimed is:

1. In combination with a water sport board of the type having a sharply angled forward tip portion, including a top, bottom, and tapered sides; means for affording protection to the user of the board from injury upon contact with said tip portion while not adversely altering the performance characteristics of the board, said means comprising:

an integral relatively soft, resilient, plastic tip cover, having a rounded exterior nose portion;

a main body portion engaging said tip, bottom, and tapered sides; and upper and lower extension portions extending rearwardly from said body portion, past the rearwardmost point of said main body portion, and engaging only said top and bottom; said tip cover being fixedly secured to said tip portion of said board.

2. The combination as defined in claim 1 wherein said tip cover extension portions taper to a point.

3. The combination as defined in claim 1 wherein said tip cover is constructed of a liquid injected silicone material and wherein said tip cover is secured to said board with silicone adhesive at said body portion and said extension portions.

4. The combination as defined in claim 3 wherein said tip cover has a durometer A hardness of about 35 to 40, a tensile strength of about 1,000–1,500 psi and a tear resistance, Die B, of about 160–175 psi.

5. The combination as defined in claim 1 wherein said tip cover is fixedly secured to said tip portion of said board by an adhesive at said body portion and said extension portions.

6. The combination as defined in claim 1 wherein said tip cover has a durometer A hardness of about 35 to 40, a tensile strength of about 1,000–1,500 psi and a tear resistance, Die B, of about 160–175 psi.

7. The combination as defined in claim 1 wherein said main body portion covers only the tip portion of the board so that said tip cover can accommodate a wide variety of widths, thicknesses, and configurations of boards.

8. The combination as defined in claim 7 wherein said main body portion extends no more than about one and one half inches along the tapered sides of said board.

9. The combination as defined in claim 8 wherein said main body portion extends about ¾ of an inch along the tapered sides of said board.

10. The combination as defined in claim 8 wherein said tip cover is constructed of a liquid injected silicone material and wherein said tip cover is secured to said board with silicone adhesive at said body portion and said extension portions.

11. The combination as defined in claim 10 wherein said tip cover has a durometer A hardness of about 35 to 40, a tensile strength of about 1,000–1,500 psi and a tear resistance, Die B, of about 160–175 psi.

12. A protective tip cover for the forward tip of a water sport board, comprising a soft, resilient cushioning member for affording protection to the user of the board during surfing without adversely affecting the performance characteristics of the board, having a rounded exterior nose portion, a main body portion, and upper and lower extensions extending rearwardly from only a center portion of the main body portion, past the rearwardmost point of said main body portion, the main body portion adapted to engage the nose and sides, top and bottom of a water sport board, and the extensions adapted to engage only the top and bottom surfaces.

13. A protective tip cover as defined in claim 12 wherein said member is constructed of a liquid injected silicone material.

14. A protective tip cover as defined in claim 13 wherein said member has a durometer A hardness of about 35 to 40.

15. A protective tip cover as defined in claim 13 wherein said member has a tensile strength of about 1,000–1,150 psi and a tear resistance, Die B, of about 160–175 psi.

16. A protective tip cover as defined in claim 12 wherein said main body portion has an interior dimension adapted to engage the tapered sides of a board with which it is utilized along a length no greater than about one and one half inches.

17. A protective tip cover as defined in claim 16 wherein said member is constructed of a liquid injected silicone material.

18. A protective tip cover as defined in claim 17 wherein said member has a durometer A hardness of about 35 to 40.

19. A protective tip cover as defined in claim 17 wherein said member has a tensile strength of about 1,000–1,150 psi and a tear resistance, Die B, of about 160–175 psi.

20. A protective tip cover as defined in claim 12 wherein said main body portion has an interior dimension adapted to engage the tapered sides of a board with which it is utilized along a length about $\frac{3}{4}$ of an inch.

* * * * *